US005453021A

United States Patent [19]

Smith

[11] Patent Number: 5,453,021

[45] Date of Patent: Sep. 26, 1995

[54] INSULATION DISPLACEMENT TERMINAL CONNECTORS

[75] Inventor: Thomas J. Smith, Bay Shore, N.Y.

[73] Assignee: TII Industries, Inc., Copiague, N.Y.

[21] Appl. No.: 220,528

[22] Filed: Mar. 31, 1994

[51] Int. Cl.[6] ..... H01R 11/20

[52] U.S. Cl. ..... 439/395; 439/402; 439/411

[58] Field of Search ..... 439/395, 396, 439/398, 399, 402, 403, 408, 411, 412, 413, 417, 786, 856, 857

[56] References Cited

U.S. PATENT DOCUMENTS

| | | | |
|---|---|---|---|
| 3,258,733 | 6/1966 | Elm | 439/411 X |
| 4,274,198 | 6/1981 | Bouley | 439/395 X |
| 4,333,700 | 6/1982 | Pugh, III | 439/403 |
| 4,597,623 | 7/1986 | Krumreich | 439/411 X |
| 4,764,125 | 8/1988 | Debortoli | 439/403 |
| 4,988,311 | 1/1991 | Tanzola | 439/411 X |

*Primary Examiner*—Z. R. Bilinsky
*Attorney, Agent, or Firm*—Martin Sachs

[57] ABSTRACT

An insulation displacement terminal connector for receiving an insulated wire therein suitable for use in a protective housing allows the simultaneous or separate use of a relatively wide range of insulated wires to be used therewith and permits a smaller diameter wire to be utilized in the same slot where a larger diameter wire was used previously.

10 Claims, 3 Drawing Sheets

INSULATION DISPLACEMENT TERMINAL CONNECTORS

BACKGROUND OF THE INVENTION

1. Field of the Invention

The present invention relates to an insulation displacement terminal connector, and more specifically, relates to an insulation displacement terminal connector suitable for multiple insertions of various wire diameters and permits the use of a smaller diameter wire after a larger diameter wire has been used in the same opening or it may simultaneously be used with two different sized wires.

2. Discussion of the Relevant Art

The art abounds with quick connect terminals of the type using spaced apart arms into which an insulated wire is placed and the insulation thereof is displaced so that electrical conduction is made to the conducting clip. As is typically shown in U.S. Pat. No. 4,682,835, disclosed by Aujla, et al., issued on Jul. 28, 1987. Another type of quick connect terminals is shown in U.S. Pat. No. 4,773,875, disclosed by Huiskes, issued on Sep. 27, 1988.

Both of the above referenced disclosures include a tapered slot which is wider on top and narrow on the bottom, contrary to the teachings of the instant invention and suffers from the generally known problems of fatiguing or stressing the arms of the terminal when a larger insulated wire is inserted into the slot and then is attempted to use the same slot for a smaller size insulated wire.

U.S. Pat. No. 4,136,920 issued to Scholtholte, et al. attempts to overcome the stressing problem caused by a larger sized wire being used in the same slot with a smaller size wire provides for the use of multiple slotted arrangements which get smaller in size as you proceed down the opening so that the larger wire never has a chance to stress the slotted opening and therefore it may also be used for smaller size electrically conductive wires once the large wire has been removed.

U.S. Pat. No. 4,548,459 issued to Mosser, III which issued on Oct. 22, 1985 discloses another embodiment suitable for accommodating a smaller size wire after a larger size wire has been used in the slot which utilizes a pair of inner resilient limbs arranged side-by-side in spaced apart relation with opposing edges defining between them a wire receiving slot and a pair of outer resilient limbs arranged in respective opposite sides and spaced apart from the pair of inner limbs. When using a larger sized insulated wire the inner limbs penetrate the insulation and established permanent connection to the wire conforming the inner limbs towards the outer limbs. Utilizing a smaller size wire thereafter will only deform the inner limbs. Whereas the larger size wire will deform both the inner and outer limbs.

All of the aforementioned patents require that a separate type of connector having a prescribed channel or separation width utilized for a particular wire size to provide reliable electrical conducting contact (sometimes referred to as a shorting terminal connector) between the wires. Generally once a larger diameter insulator wire is utilized in the connector slot or channel the connector clip is stressed beyond its limits so that a finer or thinner gauge wire cannot be used therein if it becomes necessary to do so. The clip or connector with the clip mounted therein must be discarded and a new connecting clip or contact member suitable for use with the small diameter wire must be utilized.

The present invention overcomes the shortcomings of the prior art by permitting the use of the same connector and its associated contact member or clip to be utilized even though a larger insulated wire diameter is used initially and is subsequently replaced with a thinner diameter insulated wire. Reliable electrically conductive connection is made with the thinner wire even after a larger diameter wire has been utilized in the same slot. With the unique design of the connecting terminal contact member or clip reliable electrically conductive connection is accomplished with varying diameters of insulated wires.

Therefore, it is an object of the present invention to provide a reliable and efficient means for connecting wires together.

It is another object of the present invention to provide a terminal for quickly and reliably connecting two wires of different diameters together.

It is another object of the present invention to provide a low cost insulation displacement conducting terminal which is reliable and may be reused with wires of different sizes.

It is still yet another object of the present invention to provide an insulation displacement conducting terminal which may be reused even though the wire inserted therein had a larger diameter than that to be presently used.

Therefore, the present invention provides an apparatus, which is small in size, reliable, overcomes the shortcomings of the prior art, is capable of insuring reliable electrical connection between a plurality of insulated conductive wire sizes and may be reused with wires of different diameters.

SUMMARY OF THE INVENTION

An insulation displacement conducting terminal for receiving insulated wires therein suitable for use in a protective housing, according to the principles of the present invention, includes an electrically conductive contact member having a pair of arms spaced apart with the spacing being smaller at one end and larger at the other end and terminating in a common connection portion which is provided with a strain relief permitting the arms to flex and is adapted to receive wires of different diameters therein. The common connecting portion is provided with means for affixing the contact member to the surface of a protective housing which encompasses the electrically conductive contact terminal member and has a first portion adapted to receive and have affixed thereto the contact terminal member. A second portion of the housing is adapted to cooperate with the first portion and includes through apertures adapted to receive the insulated wire therein. Means are provided for moving the second portion towards said first portion of the housing with the insulated wires disposed within said second portion through apertures whereby the insulation of the insulated wire is displaced permitting the electrically conductive portion of the insulated wire to come into electrically conductive contact with the electrically conductive contact member.

The foregoing and other objects and advantages will appear from the description to follow. In the description, reference is made to the accompanying drawing, which forms a part hereof, and which is shown by way of illustration and a specific embodiment in which the invention may be practiced. This embodiment will be described in sufficient detail to enable those skilled in the art to practice the invention, and it is to be understood that other embodiments may be utilized and structural changes may be made without departing from the scope of the invention.

The following detailed description is, therefore, not to be taken in a limiting sense, in the scope of the present invention is best defined by the appended claims.

BRIEF DESCRIPTION OF THE DRAWING

In order that the invention may be more fully understood, it will now be described, by way of example, with reference to the accompanying drawing in which.

DESCRIPTION OF THE PREFERRED EMBODIMENT

Figure 1:
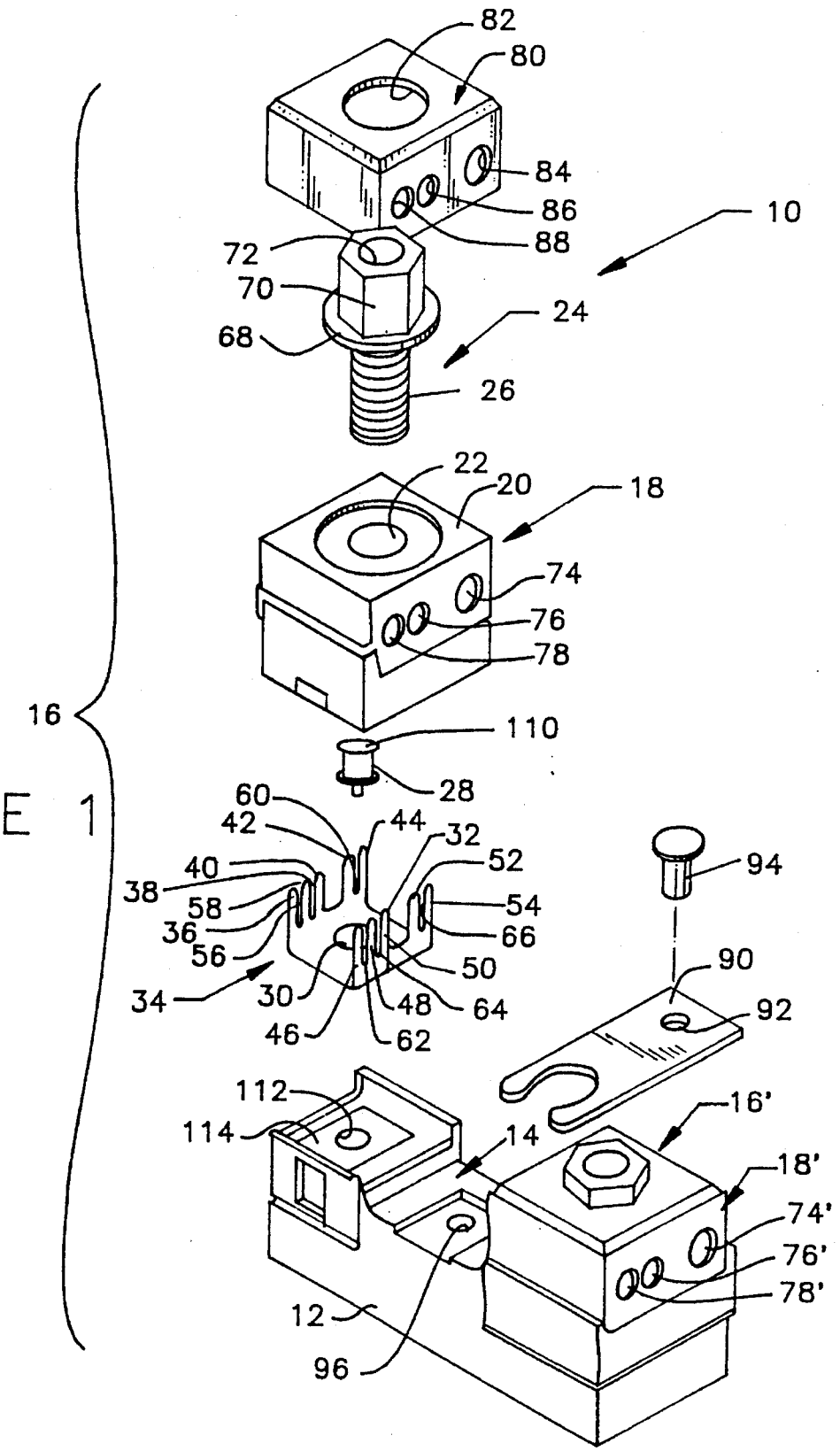
FIG. 1 is an isometric view, partially exploded, terminal connector which utilizes the insulation displacement conducting clip or contact member, according to the principles of the present invention.

Referring now to the figures, and in particular to FIG. 1, which is a partially exploded view of a telephone terminal connector module and is seen to include lower housing member 12. On the top surface 14 of the lower housing member 12 there is provided a pair of terminal assemblies 16 and 18. Terminal 16 is shown as the exploded portion of the telephone terminal module 10 and terminal assembly 16' in its completely assembled or closed position which is identical to the terminal assembly 16 with the identical components. Therefore, when the components of terminal assembly 16 are described it is to be understood that identical components are found in terminal assembly 16'.

Figure 2:
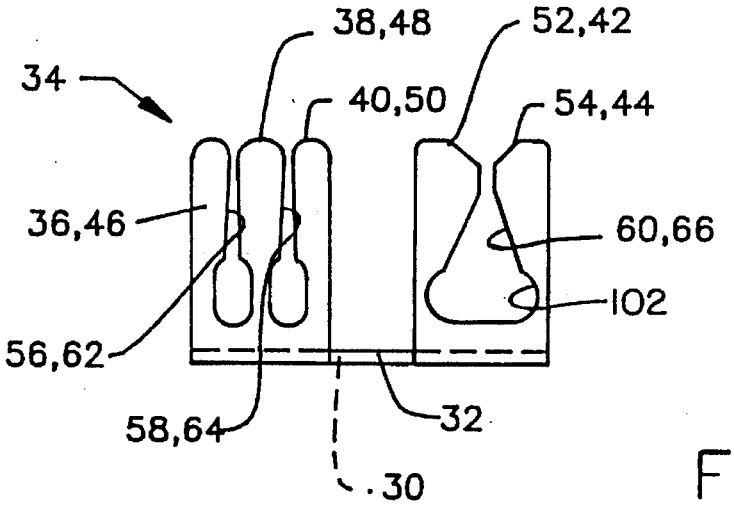
FIG. 2 is a side view in elevation of the electrically conductive contact member.
Figure 3:
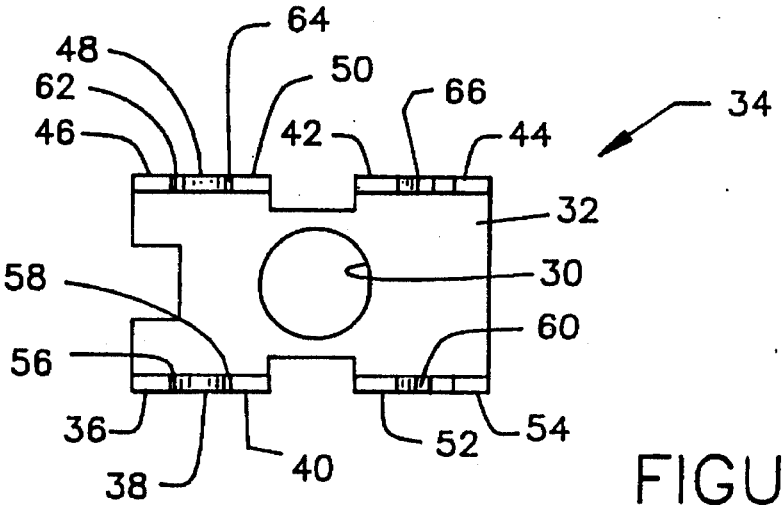
FIG. 3 is top plan view of the contact member shown in FIG. 2.
Figure 4:
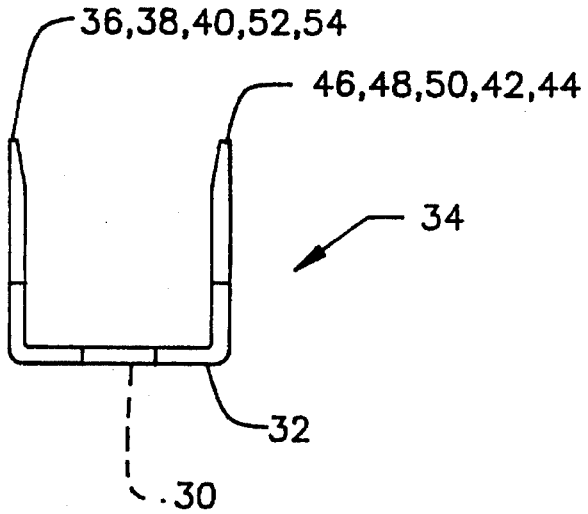
FIG. 4 is an end view in elevation of the contact member shown in FIG. 2.

The terminal assembly 16 and 16' include a generally rectangularly shaped hollow upper housing 18. The top surface 20 of upper housing 18 is provided with a generally centrally disposed through aperture 22, which is suitable for receiving a threaded bolt 24 therein. The lower threaded portion 26 is adapted to be received into the hollow threaded portion of the electrically conductive feedthrough member 28, which in turn is adapted to be inserted through aperture 30 provided in the base or central portion 32 of the U-shaped conductive contact or clip member 34, which is provided with arms 36, 38, 40, 42, 44, 46, 48 and 50. Disposed between the arms 36 and 38; 38 and 40; 42 and 44; 46 and 48; 48 and 50; and 52 and 54 are spaces or cutting slots 56, 58, 60, 62, 64 and 66, respectively. (Refer to FIGS. 2, 3 and 4 for a more detailed view of the elements comprising the insulation displacement conducting member or clip 34). Preferably the spaces or cutting slots 56, 58, 60, 62, 64 and 66 are provided with sharpened edges so they may readily displace or pierce at the insulation of an insulated wire, 98 and 106, (see FIGS. 5–8) inserted therein. The arms 36, 38, 40, 42, 44, 46, 48, 50, 52 and 54 may be affixed on opposite distant edges of the base or central portion 32 or alternatively may be made in one piece with the arms being folded upwardly from the central or base portion, as shown in FIGS. 2, 3 and 4.

The bolt 24 preferably includes a lip portion 68 and a head portion 70 which is coated with an insulated material. The bolt 24 drives the insulated wires 100 and 102 into the slots 60 through 62 by moving the upper housing 18 towards the lower housing 12 and pierces the insulation material thereby providing electrically conductive contact to the bolt 24 and to the conductive contact or clip member 34 which electrically connects together (shorts) the wires inserted through the apertures 74, 76 and 78 provided in the upper housing member 18 and 18'. Apertures (not shown) are also provided in the opposite parallel surface of the rectangularly shaped upper housing member 18 and 18' (hidden from view) and are adapted to be in alignment with the channels 56, 58, 60 and 62 and spaces or cutting slots 64, 66 and 68 which are adapted to be in alignment with spaces or cutting slots 64, 66 and 68. A top cover 80 is provided with a centrally disposed aperture 82 suitable for receiving the head portion 70 of the bolt 24 and is smaller in diameter of the lip portion 68 so that when placed upon the upper housing member top surface 20 and being affixed thereto, in a conventional manner, will hold bolt 24 captive to the upper housing member 18, thus preventing the bolt 24 from being dropped from its place during assembly in the field. Top cover 80 is also provided with apertures 84, 86 and 88 which is adapted to be in alignment with apertures 74, 76 and 78, respectively, when assembled, so that an insulated wire inserted through the apertures 84, 86 and 88 will readily enter the space or cutting slots 62, 64 and 66.

A ground terminal member 90 is provided with an aperture 92 proximate one end thereof that is adapted to receive a rivet 94 thereof and extend through aperture 92 into aperture 96 and when peened over provides a ground within the hollow lower housing member 12.

Figure 5:
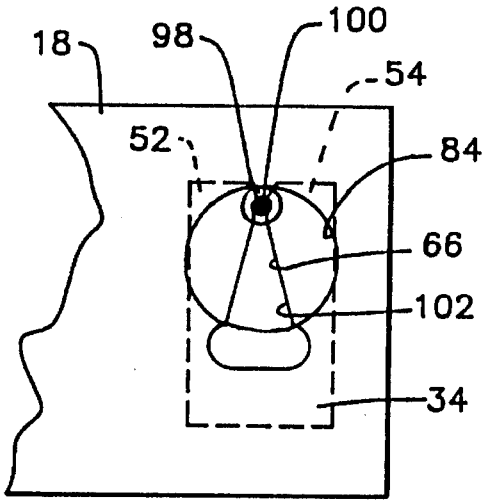
FIG. 5 is an enlarged partial side view in elevation of a relatively small diameter insulated wire being inserted into the space or opening provided in a contact member of clip.

Referring now to FIG. 5 which is a greatly enlarged end view of one of the terminal arms showing the space or cutting slots disposed therebetween. An aperture 84 typically provided in the top cover 80 is seen to receive an insulated wire 98 therein. Wire 98 is seen to have an electrically conductive portion 100 that is received into a space or cutting slot 66, which is terminated in a strain relief through aperture 102 that allows for the flexing of the arms 52 and 54 of the terminal clip member 34 without destroying its resiliency. The cutting slot 66 is provided with inwardly extending protrusions 67, which is a resting place for smaller sized insulated wires.

Figure 6:
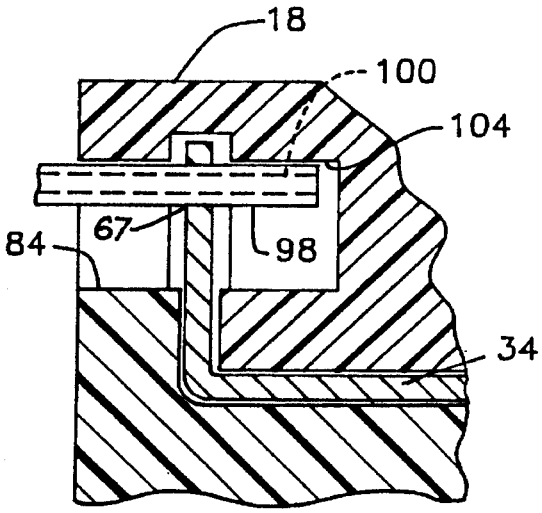
FIG. 6 is an end view into elevation of the wire inserted in the contact member of clip as shown in FIG. 5.

The view in FIG. 6, being in cross section, readily shows the smaller insulated wire 98 as it extends into the space or cutting slot 66 and it is held in position at a prescribed level determined by a ledge 104 provided in the internal portion of the upper housing member 18 and the inwardly extending protrusions 67.

Figure 7:
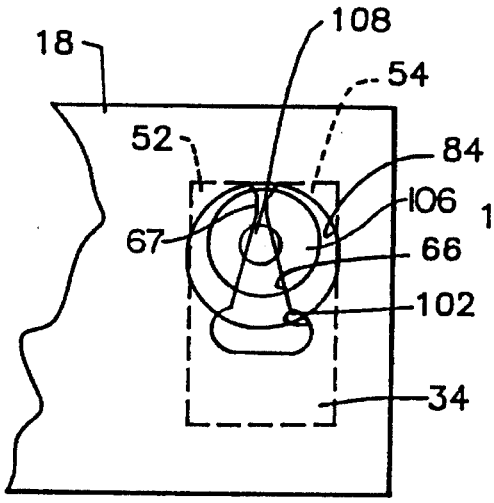
FIG. 7 is an enlarged side view in elevation of a larger diameter insulated wire being inserted into the spacing of the same contact member or clip shown in FIG. 5.

Referring now to FIG. 7, which shows a larger diameter wire inserted into the aperture in the upper housing member 18. The larger diameter insulated wire 106 is inserted into the space or cutting slot 66 in a similar matter as that shown in FIG. 5 wherein the insulation is cut away or displaced so that the central electrically conductive portion 108 can make electrically conductive contact with the edges of the cutting slot 66. Note that the larger size wire will be moved further down into the slot once the arms 52 and 54 have flexed, allowing the wire to move further down, and the arms 52 and 54 will return to their original position so that when the larger sized insulated wire 106 is removed and a smaller diameter insulated wire is inserted therein it may readily be positioned in the narrower portion of the slot at the inwardly extending protrusion 67 and still make reliable electrically conductive contact with the arms 52 and 54 of the conducting clip or contact member 34.

Figure 8:
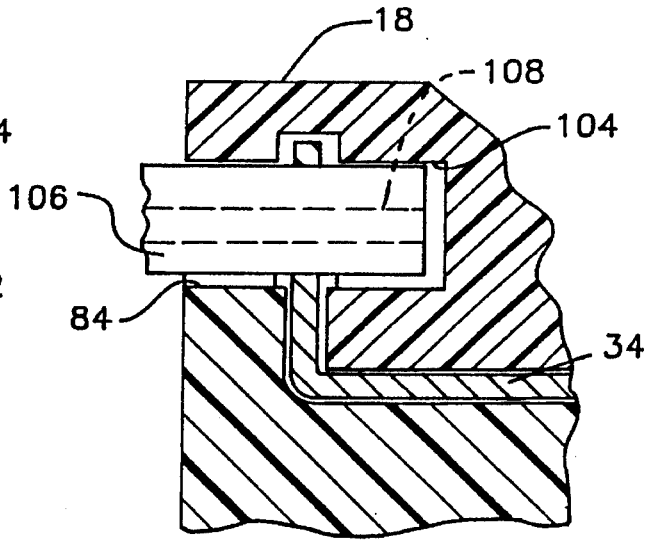
FIG. 8 is an end view in elevation of the position of the larger insulated wire when inserted into the contact member as shown in FIG. 7.

FIG. 8 shows the end view in elevation of the larger size wire 106 in position which is determined by the lip 104 of upper housing member 18 as it is moved into contact with the lower housing member 12.

In operation, a wire of either size diameter may be inserted into the aperture and a connection will be made between the electrically conductive contact member or clip and the central electrically conductive portion of the wire when the insulation is displaced or cut back and if a larger diameter wire is utilized and then replaced the clip arms will be able to flex so that the larger diameter wire can be accommodated without destroying the resiliency of the arms because the strain relief through aperture 102 permits the flexing. Once the wires are inserted into the aperture the threaded bolt 24 engages the threaded aperture 110 provided in the feedthrough member 28 which is received into the aperture 112 provided in the top surface 114 of the lower housing member 12. As bolt 24 is rotated the upper housing member 18 is brought closer to the lower housing member 12 until the insulation on the wire inserted into the aperture is displaced or cut so that electrically conductive contact may be made to the contact or clip member 34. Thus, when the upper housing member 18 is completely seated on the lower housing member 12 the wires are held in position and make reliable electrically conductive contact with the terminal clip member and therefore each other.

In referring to the various wire sizes it is to be noted that the smaller or thinner spacings (protrusions 67) of the cutting slots 66 are able to accommodate wire sizes ranging from 26 gauge down to 22 gauge and the larger spacings of the cutting slots are able to accommodate wires from 18.5 gauge (known as F/drop steel copper plated wire), 20 gauge (E wire copper coated) and 19 gauge copper wire.

Hereinbefore has been disclosed an insulation displacement terminal having contact or clip member suitable for separately or simultaneously receiving various sizes of insulated wire therein which is reliable and relatively inexpensive. It will be understood that various changes in the details, materials, arrangement of parts and operating conditions which have been herein described and illustrated in order to explain the nature of the invention may be made by those skilled in the art within the principles and scope of the present invention.

Having thus set forth the nature of the invention, what is claimed is:

1. An insulation displacement terminal connector for receiving insulated wires therein comprising:

A. an electrically conductive contact member, said contact member being provided with;

i) an elongated pair of arms, said pair of arms being spaced apart at one distal end with the spacing being smaller proximate said one end and larger proximate the other end adapted to receive the electrically conducting portion of said insulated wire at said one distal end and make electrically conductive contact therewith, ii) a common connecting portion, said connecting portion being disposed at the other distal end of said pair of arms and is provided with a strain relief through aperture communicating with said other end spacing, iii) means disposed in said common connecting portion for affixing said contact terminal member to a surface, and B. a protective housing means for encompassing said electrically conductive contact terminal member, said housing means having;

i) a first portion having a surface adapted to receive and have affixed thereto said contact member, ii) a second portion adapted to cooperate with said first portion and including a through aperture adapted to receive said insulated wire therein; and iii) means for moving said second portion towards said first portion with said insulated wire disposed within said second portion through aperture;

whereby the insulation of said insulated wire is displaced permitting the electrically conductive portion of said insulated wire to come into electrically conductive contact with said electrically conductive contact member.

2. An insulation displacement terminal connector for receiving insulated wires therein comprising:

A. an electrically conductive generally U-shaped contact member, said contact member being provided with;

i) a central portion, ii) two elongated pairs of arms, each of said pairs of arms being spaced apart at one distal end with the spacing being smaller proximate said one end and larger proximate the other end adapted to receive the electrically conducting portion of said insulated wire at each said one distal end and make electrically conductive contact therewith, iii) a common connecting portion, said connecting portion being disposed at the other distal end of each said pair of arms and is provided with a strain relief through aperture communicating with each said other end spacing, the distal ends of said common connecting portion being connected to the distal ends of said central portion, iv) means disposed in said central portion for affixing said contact terminal member to a surface, and B. a protective housing means for encompassing said electrically conductive contact member, said housing means having;

i) a first portion having a surface adapted to receive and have affixed thereto said contact member, ii) a second portion adapted to cooperate with said first portion and including at least two through apertures adapted to receive said insulated wires therein; and iii) means for moving said second portion towards said first portion with said insulated wires disposed within said second portion through apertures;

whereby the insulation of said insulated wires are displaced permitting the electrically conductive portion of said insulated wires to come into electrically conductive contact with said electrically conductive contact member.

3. An insulation displacement terminal connector for receiving an insulated wire therein according to claim 1 or 2, wherein said spaced apart arms are provided with sharpened edges to facilitate the displacing of the insulation from said insulated wire.

4. An insulation displacement terminal connector for receiving an insulated wire therein according to claim 2, wherein said protecting means second portion through apertures are in line.

5. An insulation displacement terminal connector for receiving an insulated wire therein according to claim 1 or 2, wherein said spaced apart arms are fabricated to retain the conducting portions of said insulated wires therebetween after the insulation has been displaced from said insulated wire.

6. An insulation displacement terminal connector for receiving an insulated wire therein according to claim 1 or 2, wherein said spaced apart arms are provide with an enlarged spaced apart opening at said one end communicating with the spacing between said arms.

7. An insulation displacement terminal connector for receiving an insulated wire therein according to claim 1 or 2, wherein said spaced apart arms are fabricated to accommodate insulated wires of different sizes and retain the conducting portion of said insulated wires therebetween after the insulation has been displaced from said insulated wire.

8. An insulation displacement terminal connector for receiving an insulated wire therein according to claim 1 or 2, wherein said spaced apart arms are provide with inwardly extending protrusions disposed proximate said opening at said one end.

9. An insulation displacement terminal connector for receiving an insulated wire therein according to claim 5, wherein said spaced apart arms are provide with an enlarged spaced apart opening at said one end communicating with the spacing between said

10. An insulation displacement terminal connector for receiving an insulated wire therein according to claim 5, wherein said spaced apart arms are provide with inwardly extending protrusions disposed proximate said opening at said one end.

* * * * *